US005669305A

United States Patent [19]

Bayer et al.

[11] Patent Number: 5,669,305

[45] Date of Patent: Sep. 23, 1997

[54] SHEET-CONVEYING DRUM BODY FOR A PRINTING MACHINE

[75] Inventors: Harald Bayer, Rodgau; Klemens Kemmerer, Seligenstadt, both of Germany

[73] Assignee: MAN Roland Druckmaschinen AG, Germany

[21] Appl. No.: 522,629

[22] Filed: Sep. 1, 1995

[30] Foreign Application Priority Data

Sep. 1, 1994 [DE] Germany ..... 44 31 114.1

[51] Int. Cl.[6] ..... B41F 1/30

[52] U.S. Cl. ..... 101/409; 101/246

[58] Field of Search ..... 101/246, 216, 101/409, 420; 271/187, 275, 277, 315

[56] References Cited

U.S. PATENT DOCUMENTS

| | | | |
|---|---|---|---|
| 2,933,039 | 4/1960 | Claybourn et al. . | |
| 3,642,274 | 2/1972 | Herrington et al. | 101/420 |
| 3,780,925 | 12/1973 | Teines | 101/420 |
| 4,815,379 | 3/1989 | Becker et al. . | |
| 5,050,500 | 9/1991 | Spiess | 101/420 |

FOREIGN PATENT DOCUMENTS

| | | |
|---|---|---|
| 57 345 | 5/1970 | German Dem. Rep. . |
| B 1 102 767 | 3/1961 | Germany . |
| 36 02 084 C2 | 12/1989 | Germany . |

*Primary Examiner*—Ren Yan

*Attorney, Agent, or Firm*—Leydig, Voit & Mayer, Ltd.

[57] ABSTRACT

A sheet-conveying drum for a printing machine with speed apart bearings, the drum including a drum body with a prismatic shape including end faces and side faces, drum journals secured to the end face for journalling the drum for rotation in the bearings, at least two gripper bridges extending between the end faces and disposed symmetrically about the periphery of the drum body, the side faces including communicating openings extending into and through the drum body for allowing the flow of air therethrough as the drum rotates.

16 Claims, 5 Drawing Sheets

SHEET-CONVEYING DRUM BODY FOR A PRINTING MACHINE

FIELD OF THE INVENTION

The invention relates generally to printing machines, and more particularly to a sheet-conveying drum for a printing machine which serves for sheet conveying within the printing machine, preferably between individual printing units of a rotary printing machine.

BACKGROUND OF THE INVENTION

A sheet-conveying drum of this general type is known from DE-B 1,102,767. According to that patent, a gripper bridge is arranged on a hollow, reduced diameter sheet-conveying drum. The gripper bridge grips the leading edge of a sheet for conveying the sheet between impression cylinders. A sheet guiding device is assigned to the sheet-conveying drum at a slightly larger radius than the gripper bridge. A gripper bar associated with the gripper bridge includes an impact strip which is designed with a rectangular cross-section. During rotation, the strip brings about a uniform vacuum between the sheet and the assigned sheet guiding device. The gripper impact strip sucks some of the air off the sheet guiding device to reduce the pressure in that region so that the sheet is pressed by the normal air pressure from the inner side of the sheet against the sheet guiding device.

A disadvantage of this device is that, after transfer of the sheet from the sheet-conveying drum to the associated downstream impression cylinder, the rear region of the sheet can no longer be guided on the sheet guiding device as a result of the pressure generated by the impact strip, i.e. the sheet lifts off. The lifting-off of the sheet in the rear region leads to advance ghosting ahead of the nip formed by the impression cylinder and the blanket cylinder.

A further sheet-conveying drum is known from DE 3 602 084 C2. The disclosed drum is triple-sized and includes three symmetrically spaced gripper bridges. The drum also includes guide surfaces designed essentially as secants between at least two gripper bridges within the drum circumference. The guide surfaces are intended to serve as air vanes which during printing operation generate an air bank which keeps the respective sheet with the printed surface away from the air vane guide surfaces and is thus intended to guarantee sheet conveying without smearing or ghosting. The guide surfaces can also perform the sheet conveying in combination with a sheet guiding device arranged outside the radius of the drum. The guide surfaces also serve to guide the trailing edge of the sheet during transfer of the sheet to the following impression cylinder.

Furthermore, it is known in printing machine construction to design sheet-conveying drums as prismatic bodies in the form of a cuboid. A "prismatic body" is a body in the shape of a prism, i.e. having polygonal end faces that are congruent and parallel, and whose side faces are parallelograms. A "cuboid" is a form of prism having six faces, all of which are rectangular. Gripper bridges are arranged on opposing side faces of the cuboid and the other two side faces are designed as continuous surfaces and constitute guide surfaces. Attached to the end faces are drum journals which are mounted on the frame side. Depending on the printing material to be processed, two drum caps of circular segment shape can be arranged on the cuboid, which in turn form a cylindrical drum.

It is a disadvantage of these designs that the drum has a high mass due to its design. During printing operation, individual centrifugal forces occur, depending on the number of gripper bridges, which have an adverse effect on the register accuracy. Furthermore, the desired dynamic pressure exerted on the sheet by means of guide surfaces serving as air vanes is dependent on the machine speed and is thus subject to fluctuations.

SUMMARY OF THE INVENTION

The primary object of the invention is to provide a sheet-conveying drum body with a low mass, which has a high rigidity, such that a precise register accuracy is achieved and such that the drum body itself avoids an air bank generated by guide surfaces and which act on the sheet.

These and other objects and advantages are realized by providing a sheet-conveying drum body that is essentially hollow and includes communicating openings extending therethrough. By virtue of the communicating openings arranged in outside surfaces of and extending through the drum body, the formation of an airbank between the drum and the sheet and which acts on the sheet being conveyed is avoided. Rather, an ambient air stream flows through the communicating openings counter to the sheet running direction during rotation of the drum bodies, such that the sheet is essentially conveyed only by centrifugal moments. No waviness occurs in the sheet during conveyance, that could otherwise lead to "flutter" in the rear region. Rather, the sheet is conveyed smoothly to a downstream location, preferably being guided on an adjacent sheet guiding device of slightly larger radius than the drum. Moreover, by virtue of the arrangement of communicating openings in the side surfaces of the drum, the drum has an appreciably reduced mass. The reduced mass in turn lowers the production costs, and the drum body is preferably produced in gray cast iron, spherulitic cast iron or light metal casting, preferably aluminum casting. Further, the constructional shape of the drum is rigid which leads to less deflection of the drum during sheet conveyance, and thus to improved register accuracy.

According to a first embodiment of the invention, the drum body is in the form of a prismatic shaped member. The prismatic shaped member includes end faces upon which drum journals are fixed and also includes a plurality of substantially flat, rectangular side faces. In the case of the cuboid drum body, gripper bars are disposed upon opposing side faces of the prismatic shaped body. If the prismatic shaped body is at triangular prism, three gripper bridges are disposed adjacent the truncated intersections of the three side faces of that body. In either case, the side faces include means defining communicating openings giving the advantageous air flow described above.

In the second embodiment of the invention, the drum body is formed by radially-disposed cuboids which are joined along an axis of rotation and extend radially from that axis. The faces of the cuboid adjacent the periphery of the drum receive gripper bridges. The remaining side faces of each cuboid include the means defining communicating openings for providing the advantageous airflow properties previously described.

The drum body provided with means defining communicating openings is not limited to a sheet-conveying transfer drum in printing units. On the contrary, the drum body is also suitable as a delivery drum, intermediate drum, or in extension modules or the like.

BRIEF DESCRIPTION OF THE DRAWINGS

The invention is to be explained in greater detail by way of the exemplary embodiments in the drawings, wherein.

DESCRIPTION OF THE PREFERRED EMBODIMENTS

While the invention will be described with reference to the preferred embodiments, it will be obvious to those of ordinary skill in the art that variations of these preferred embodiments may be used and it is intended that the invention may be practiced otherwise than as specifically described herein. Accordingly this invention includes all modifications and equivalents encompassed within the spirit and scope of the invention as defined by the appended claims.

Figure 1:
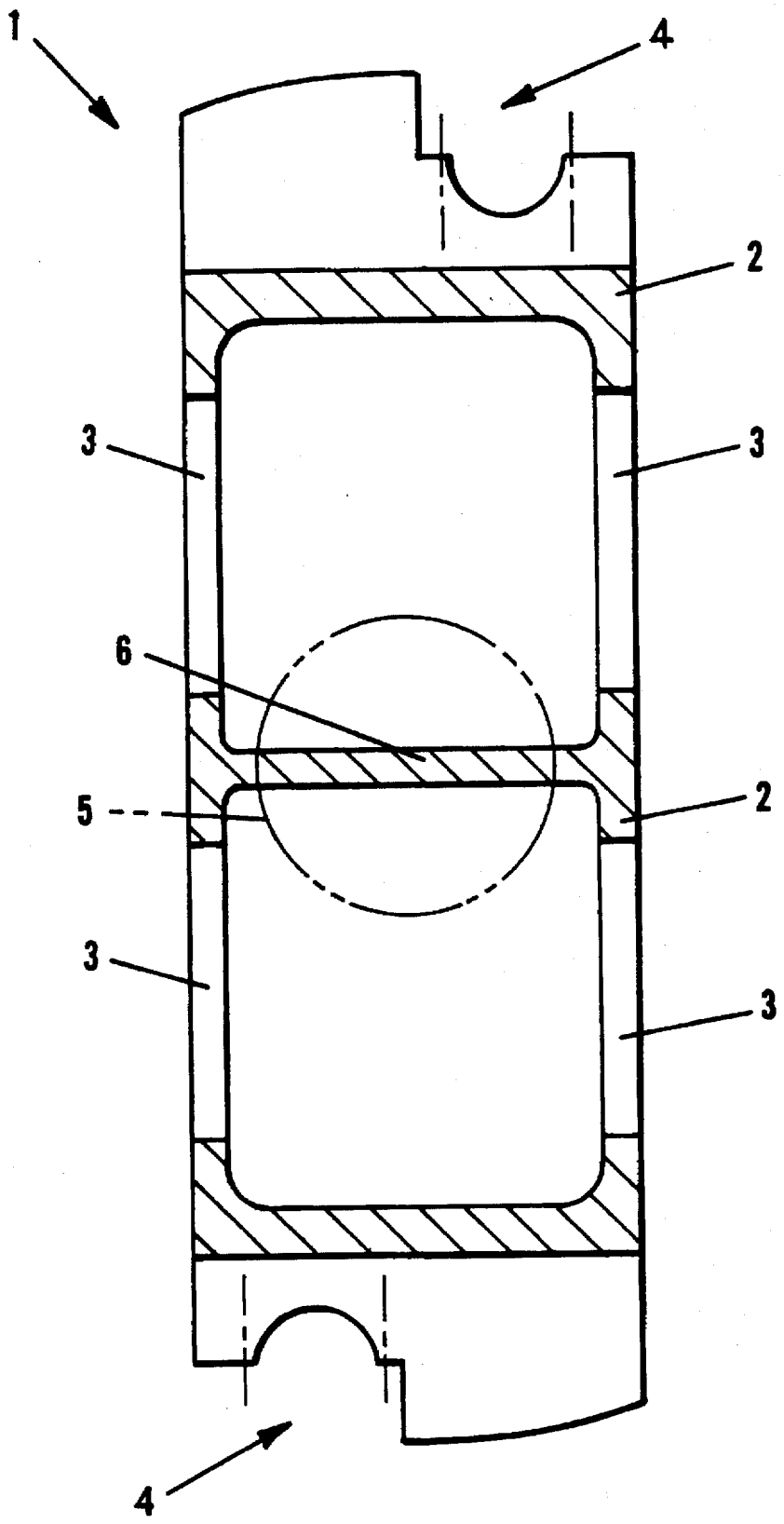
FIG. 1 shows a section view of a drum body for two gripper bridges substantially as seen along line A—A in FIG. 2.

A sheet-conveying drum body according to the invention is intended to be arranged in an offset rotary printing machine such that it is downstream of an impression cylinder and such that a further printing unit is arranged downstream of the drum, as is generally shown in FIG. 1 of DE 3 602 804 C2. A sheet-conveying drum 1, according to a first embodiment of the invention (FIGS. 1 and 2) is constructed with a double-size diameter in relation to a single-size impression cylinder and thus bears two gripper bridges 4. The gripper bridges 4 are arranged symmetrically (offset by 180°) on the periphery of the drum 1. Each gripper bridge 4 consists of a gripper shaft, grippers and at least one gripper impact strip. For each gripper, the gripper impact strip carriers assigned pad blocks for the individual gripper pad. The drum 1 is journalled for rotation relative to bearings in a frame of the printing machine by means of its two drum journals 5 secured to opposite ends of the drum 1.

Figure 2:
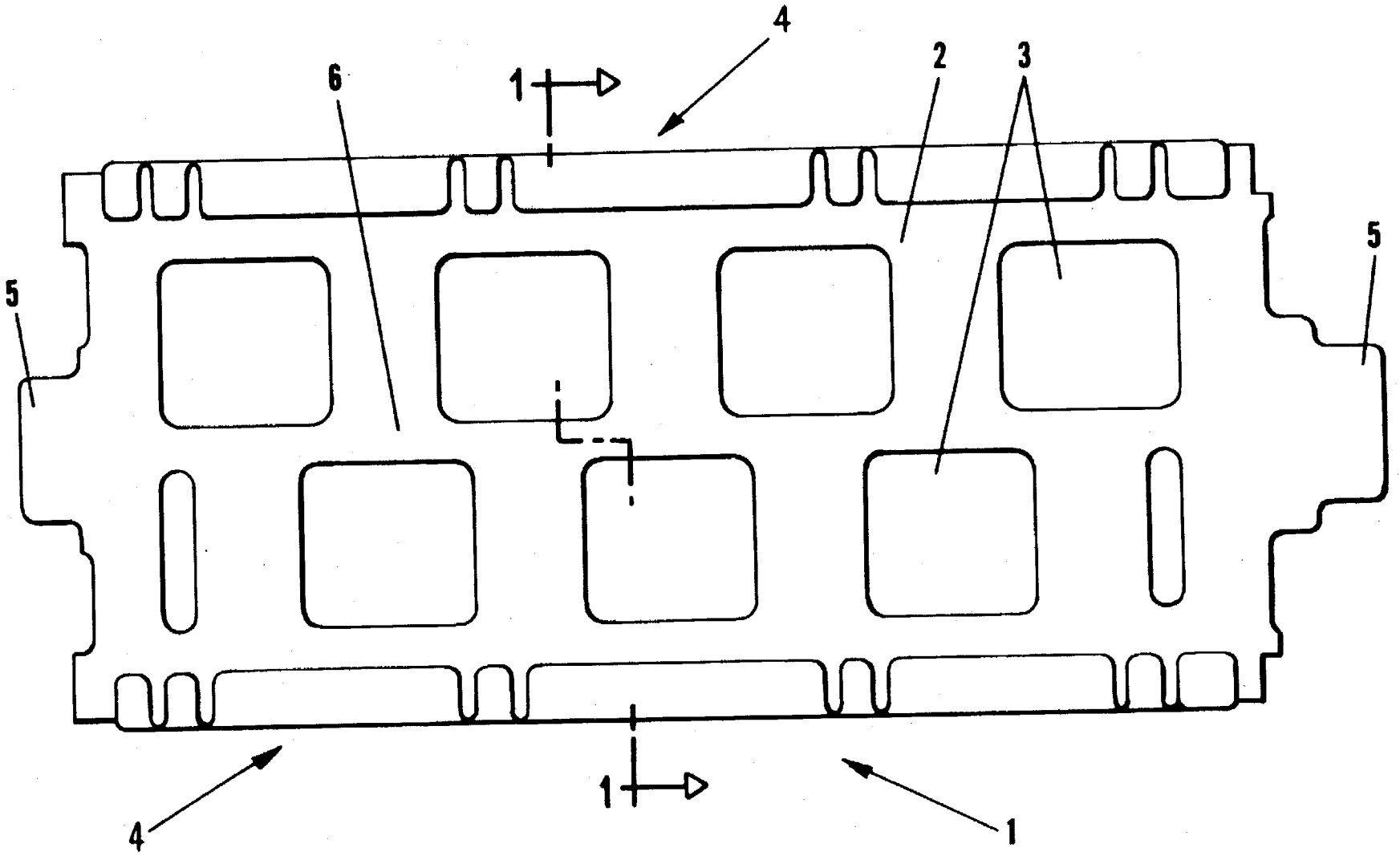
FIG. 2 shows the drum body according to FIG. 1 in a front elevation.

The basic shape of the drum 1 is defined by a drum body formed as a prismatic shaped member. As a double size drum 1 (according to FIGS. 1 and 2) the prismatic shaped member is essentially a cuboid, including a first pair of opposed side faces (the top and bottom faces in FIG. 1) upon which the gripper bridges are fixed. In this design, the gripper bridges 4 are arranged symmetrically (offset by 180°) on the periphery of the drum. The drum journals 5, already mentioned are arranged on the opposed end faces of the cuboid along the axis of rotation of the drum 1. The second pair of opposed side faces of the cuboid (one of which is seen in FIG. 2) include a multiplicity of opening 3 which are connected to one another so as to extend in and through the drum body. In the present embodiment, the openings 3 are made in the hollow profile 2 of the drum body, and are arranged either approximately congruently or offset on each of the side surfaces. The present embodiment also includes an axially continuous web of material 6 arranged in the hollow profile 2 to reinforce the axis of rotation of the double size drum 1. The web 6 merges into the drum journal 5. While drum 1 is designed as a hollow profile 2 it could also be designed from solid material or in a structure such as a honeycomb structure. In any case, the openings 3 in the sidewall which is at the front in the sheet conveying direction are designed to be in communication with openings 3 in the opposed, rear sidewall. Because of the rotary movement of the drum 1, the ambient air flows through the openings 3 and past the gripper bridges 4, thus allowing the sheet to be acted on only by centrifugal moments.

Figure 3:
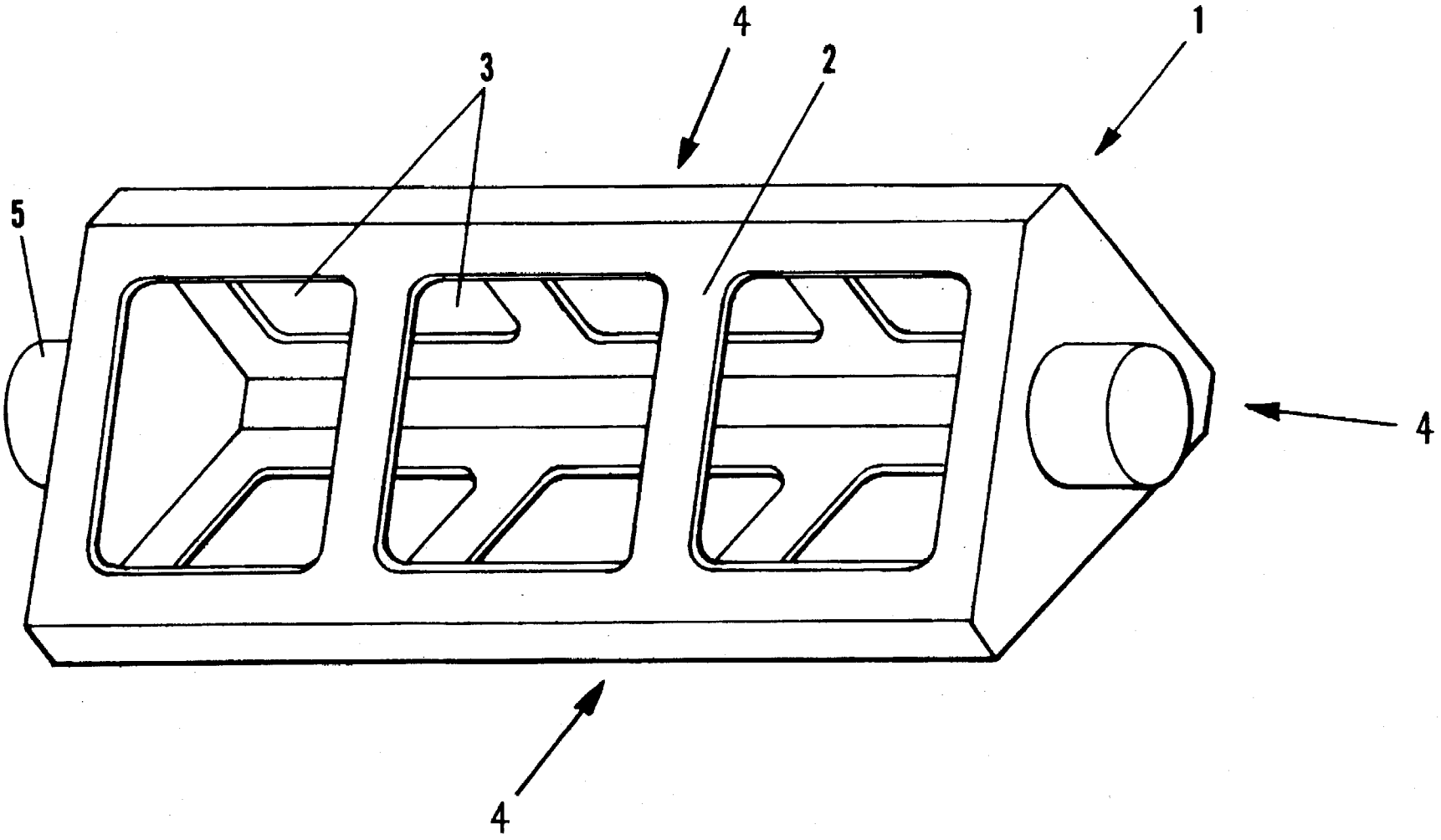
FIG. 3 shows a drum body for three gripper bridges in a triangular prism shape.

An alternative embodiment of a drum body including a prismatic shaped member is shown in FIG. 3. In that case, the prismatic shaped member is a triangular prism, having triangular end faces 4 and rectangular side faces. The gripper bridges 4 are disposed adjacent the truncated intersections of two of the side faces. As in the previous embodiment, communicating openings 3 are formed in the hollow profile 2 of the drum 1.

Figure 4:
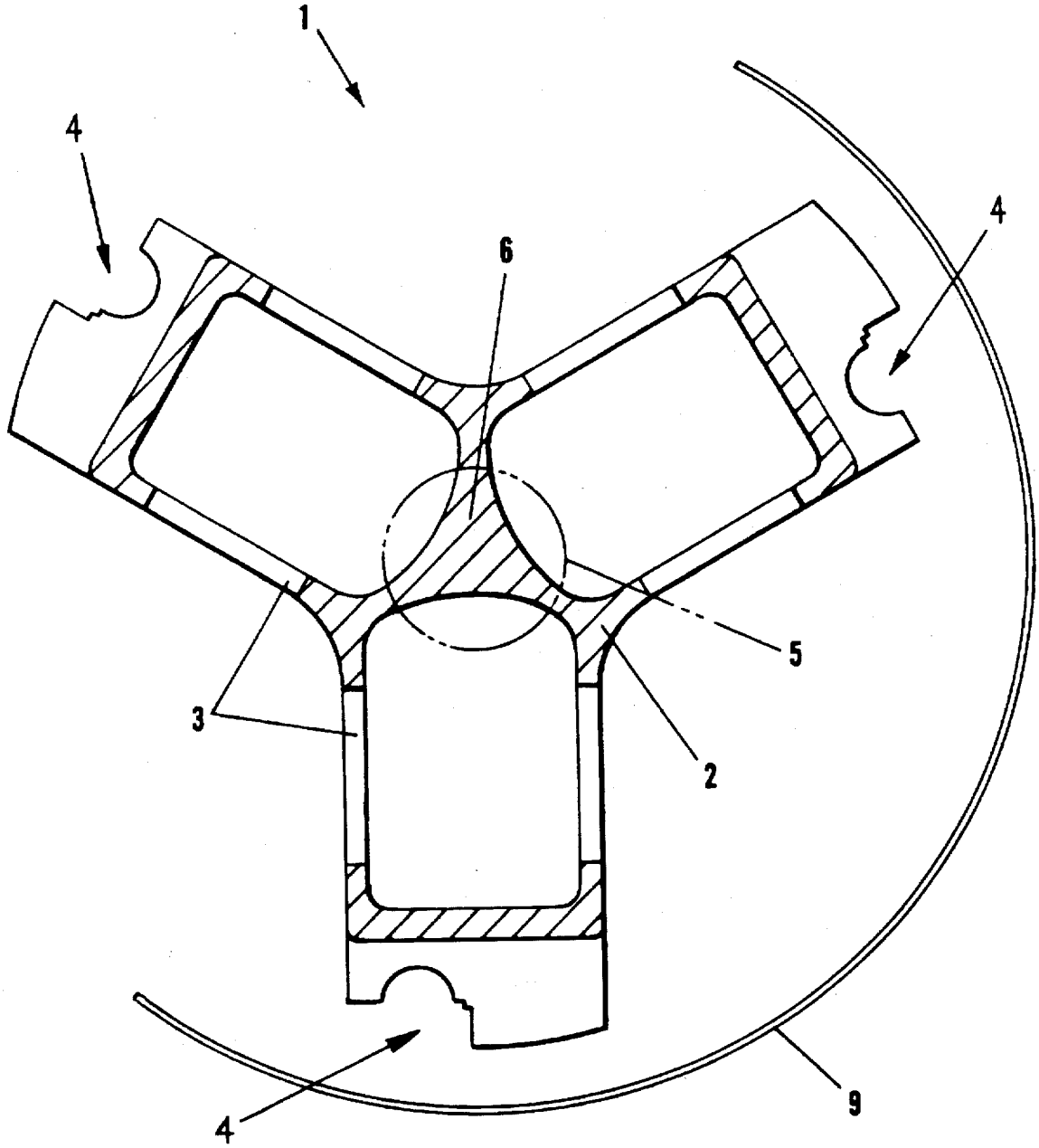
FIG. 4 shows a drum body for three gripper bridges having substantially a three pointed star shape.

A further alternative embodiment is shown in FIG. 4. The drum 1 in FIG. 4 is a triple-sized drum body essentially formed by three cuboids which are joined in a three pointed star-shaped pattern radiating outwardly from the axis of rotation of the drum 1. In the embodiment of FIG. 4, the axis of rotation is preferably formed by the web 6. The gripper bridges 4 are arranged symmetrically (i.e. offset by 120°) on the triple size drum 1. Each of the three cuboids includes a first pair of opposed side faces. One of this pair of side faces is disposed adjacent to the axis of rotation while the other holds a gripper bridge 4. The other opposed pair of side surfaces on each cuboid contain the communicating openings 3. The triple size drum according to FIG. 4 is also constructed as a hollow profile 2. Further, the axially extended web 6 is arranged so as to merge in the drum journals 5 in the region of the axis of rotation.

The double-sized drum of FIGS. 1 and 2 could also be considered as two cuboids joined at the central web 6, and extending radially from that axis of rotation. Again, the first pair of opposed side faces would be adjacent the axis and at the periphery of the drum, respectively. The other pair of opposed side faces include the communicating openings.

Figure 5:
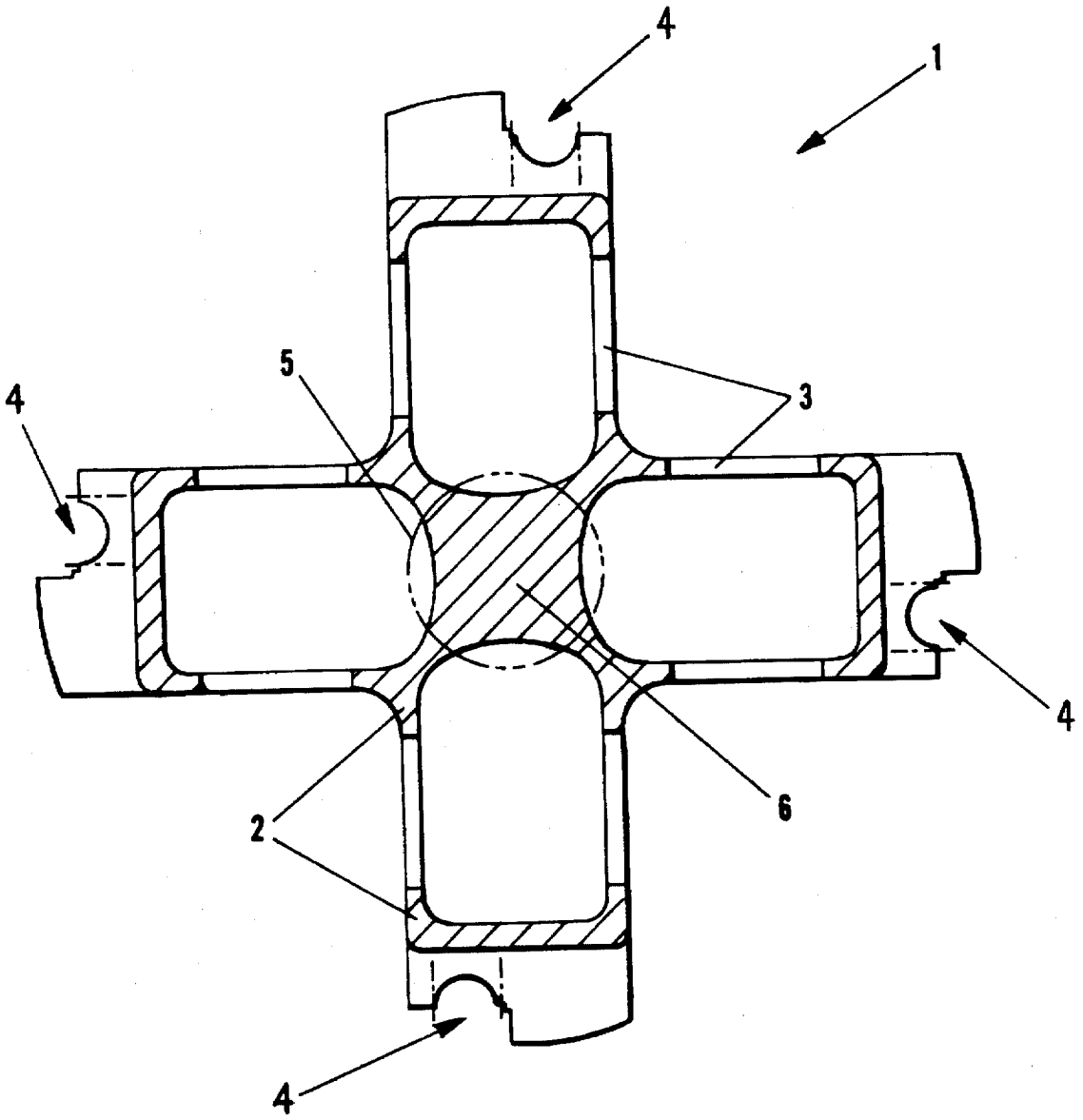
FIG. 5 shows a drum body for four gripper bridges having a substantially a four pointed star or cross shape.

A similar, quadruple-sized drum 1 is shown in FIG. 5 and is essentially formed by four cuboids joined in a radiated manner about an axis of rotation to form a four pointed star or cross shape. Alternatively, a quadruple-sized drum could also be formed as a tetragonal prism (not shown). In FIG. 5 the gripper bridges 4 are arranged symmetrically on the periphery (i.e. offset by 90°). Drum 1 is again constructed as a hollow profile and has a web 6 which merges into the drum journals 5 in the region of the axis of rotation. A first pair of opposed side faces on each cuboid are disposed adjacent the axis of rotation and receive the gripper bridges 4, respectively. The second pair of opposed side surfaces on each cuboid include the communicating openings 3. In each of the embodiments, the side surfaces can be either a flat or curved design.

In any of the embodiments of the invention just described, sheet guiding devices may be used in combination with the drums. Such sheet guiding devices 9 (see FIG. 4) are preferably arranged outside of the drum circumference, such that the unprinted side of the sheet is conveyed along these devices as the drums 1 are rotated. The location of such a sheet guiding device would be similar to the location shown in FIG. 1 of DE 3602 804 C2, although the structure and function of that drum and the drum according to this invention differ.

The mode of operation is as follows:

A sheet is fed to the drum 1 by an upstream cylinder. The drum 1 receives the sheet with one of its gripper bridges 4. The sheet fixed in the gripper closure is conveyed by the drum into the sheet descending path and then into the sheet rising path, and is subsequently passed on to the downstream impression cylinder. Because of the rotary movement of the drum body, the ambient air flows through the openings 3 formed in the drum 1, and past the group of bridges 4. Depending on the machine speed, the sheet is thus pressed by only a centrifugal moment against the sheet guiding devices (if present) and is conveyed on that sheet guiding device into the transfer region. By virtue of this operation, this sheet displays smooth sheet running without any wavy movement of the rear region of the sheet. No air bank acts on the printed side of the sheet to keep it away from the guide surfaces as in previous designs. The communicating openings according to the invention provide for this advantageous function.

What is claimed is:

1. A sheet-conveying drum for a printing machine having spaced apart bearings, said drum comprising in combination:

a drum body in the form of a one-piece prism which consists of two end faces and a plurality of side faces;

drum journals secured to the end faces of the drum for journalling the drum for rotation in the bearings of the printing machine;

at least two gripper bridges extending between the end faces and being disposed symmetrically about the periphery of the prism; and said side faces being formed with communicating openings extending into and through the drum body for allowing the flow of air through the drum body as the drum rotates.

2. The sheet-conveying drum of claim 1, wherein the drum body is a cuboid, and two gripper bridges are disposed on opposing side faces of the cuboid.

3. The sheet-conveying drum of claim 1, wherein said body is a triangular prism having truncated intersections of the side surfaces, and one of said gripper bridges is disposed adjacent each said truncated intersection.

4. The sheet-conveying drum of claim 1, including a sheet guiding device disposed outside a circumference formed by the rotating drum.

5. The sheet-conveying drum of claim 1, wherein said side faces are curved.

6. The sheet-conveying drum of claim 1 in which said side faces are flat.

7. The sheet-conveying drum of claim 1 in which said side faces are rectangular shaped.

8. The sheet-conveying drum of claim 1 in which said drum body is a hollow structure and said openings permit air flow into and through said structure as the drum is rotated.

9. A sheet-conveying drum for a printing machine having spaced apart bearings, the drum comprising in combination:

a drum formed of at least two cuboids disposed in a radial configuration about an axis of rotation, each cuboid having two end faces and first and second opposed pairs of side faces, one of the side faces of said first pair being disposed adjacent the axis of rotation and the other of the side faces of said first pair being disposed at a periphery of the drum body;

drum journals secured to the drum body at opposite ends of the axis of rotation for journalling the drum for rotation in the bearings of the printing machine;

a gripper bridge disposed on each cuboid on said other side face of said first pair at the periphery of the drum body; and the second pair of opposed side faces of each cuboid having communicating openings extending into and through the drum body for allowing the flow of air therethrough as the drum rotates.

10. The sheet conveying drum of claim 9, wherein two of said radially-disposed cuboids are joined at a central web.

11. The sheet-conveying drum of claim 9 wherein the drum body includes three radially-disposed cuboids joined at a central web.

12. The sheet conveying drum of claim 9, wherein the drum body includes four radially-disposed cuboids joined at a central web.

13. The sheet-conveying drum of claim 9, including a sheet guiding device disposed outside a circumference formed by the rotating drum.

14. The sheet-conveying drum of claim 9, wherein said side faces of said second pair are curved.

15. The sheet-conveying drum of claim 9 in which the side faces of said second pair are flat.

16. The sheet-conveying drum of claim 9 in which the side faces of said second pair are rectangular shaped.

* * * * *